US005786028A

United States Patent [19]

Cantwell

[11] Patent Number: 5,786,028

[45] Date of Patent: Jul. 28, 1998

[54] MASKING TAPE AND METHOD

[76] Inventor: Jay S. Cantwell, 3905 Avery Place Ct., Bridgeton, Mo. 63044

[21] Appl. No.: 708,535

[22] Filed: Sep. 5, 1996

[51] Int. Cl.[6] ..... B05D 1/32; B05D 1/02

[52] U.S. Cl. ..... 427/282; 427/421; 118/301; 118/505

[58] Field of Search ..... 427/448, 282, 427/272, 421; 118/505, 301

[56] References Cited

U.S. PATENT DOCUMENTS

| | | | |
|---|---|---|---|
| 2,507,958 | 5/1950 | Cassman | 427/282 |
| 2,954,868 | 10/1960 | Swedish, Jr. et al. | 428/153 |
| 2,959,152 | 11/1960 | Byers et al. . | |
| 3,482,683 | 12/1969 | Desnoyers | 428/153 |
| 3,607,381 | 9/1971 | Fairbairn | 427/448 |
| 3,782,328 | 1/1974 | Franz | 118/301 |
| 3,930,069 | 12/1975 | Stephens | 427/142 |
| 4,024,312 | 5/1977 | Korpman | 428/343 |
| 4,201,799 | 5/1980 | Stephens | 427/142 |
| 4,331,716 | 5/1982 | Stark | 427/282 |
| 4,341,828 | 7/1982 | Stephens | 428/40 |
| 4,420,520 | 12/1983 | Jones et al. | 428/42 |
| 4,430,137 | 2/1984 | Jones | 156/247 |
| 4,536,421 | 8/1985 | Matsuzawa et al. | 427/282 |
| 4,547,410 | 10/1985 | Panush et al. | 427/388.2 |
| 4,656,058 | 4/1987 | Stark | 427/282 |
| 4,695,486 | 9/1987 | Stark | 427/282 |
| 4,789,579 | 12/1988 | Tutas et al. | 428/41 |
| 4,839,206 | 6/1989 | Waldenberger | 428/40 |
| 4,996,092 | 2/1991 | Francis et al. | 428/157 |
| 5,128,176 | 7/1992 | Schmidt | 427/140 |
| 5,322,727 | 6/1994 | Yankus et al. | 428/266 |
| 5,508,097 | 4/1996 | Hauser et al. | 428/252 |

FOREIGN PATENT DOCUMENTS

| | | | |
|---|---|---|---|
| 483377A1 | 5/1992 | European Pat. Off. | 118/505 |

*Primary Examiner*—Katherine A. Bareford
*Attorney, Agent, or Firm*—Grace J. Fishel

[57] ABSTRACT

A masking tape used in spray application or removal of coatings along a demarcation line. The tape is engineered so that during the spraying process the coating being applied or the abrasive grit being used to remove a coating makes substantially no contact with the lateral edge of the tape along a shadow zone flanking the demarcation line. The shadow zone is formed between the demarcation line and the tape in line of sight with the coating or grit being sprayed. In a preferred embodiment for use in spray painting vehicles on a production basis, the body of the tape is rubber with a release coating applied to its top surface formed of polyethylene film.

4 Claims, 2 Drawing Sheets

MASKING TAPE AND METHOD

BACKGROUND OF THE INVENTION

1. Field of the Invention

The present invention relates to a masking tape which can be used in spray application or removal of coatings along a demarcation line during which process the coating being applied or the abrasive grit being used to remove a coating makes substantially no contact with the tape along a shadow zone flanking the demarcation line. The masking tape is configured to form a shadow zone between the demarcation line and the tape in line of sight with the coating or grit being sprayed. In a preferred embodiment, the masking tape is self-wound and can withstand temperatures of a drying oven and is flexible so that it can be used on curved surfaces such as on automobile body panels.

2. Brief Description of the Prior Art

In many industries, it is desired to apply a coating on one side of some predetermined demarcation line so that, for example, the workpiece is one color or tone on one side of the demarcation line and another color or tone on the other side of the demarcation line. This type of coating is often associated with the automobile industry and the demarcation line is made with a masking tape.

With the most basic type of masking tape, the tape is affixed to the workpiece with one tape side edge disposed coextensive with the demarcation line. The masking tape thus separates that portion of the workpiece surface which is to be painted from that portion which is not to be painted. The paint is applied to the workpiece and sprayed over the masking tape along the demarcation line. After the paint is dry, the tape is peeled away from the workpiece, lifting portions of the paint along the demarcation line, forming a ragged edge. This is particularly a problem with enamel paints in the automobile industry which tend to be applied in thicker coats. In addition, ordinary masking tapes have no stretch and cannot be used along a demarcation line that is curved in more than one plane such as along a highlight line on a vehicle body panel.

There are masking tapes which address the problem of lifting the paint by feathering it at the demarcation line so that it is substantially zero thickness at the point it makes contact with the masking tape. U.S. Pat. No. 3,930,069 to Stephens describes a paper masking tape with a side edge having no adhesive. The adhesive treated portion of the Stephens' tape is applied along the demarcation line, while the untreated portion is bent upwardly at an angle. As paint is sprayed into the pocket formed between the workpiece and the upstanding portion of the tape, the upwardly bent portion of the tape restricts the amount of paint reaching the workpiece, feathering the edge of the paint along the demarcation line.

Stephens' tape is designed for refinish applications, where a repainted zone is to be blended into a prepainted zone, and it is not functional for establishing a full-thickness paint coating up to the demarcation line. In addition even for refinish applications, the Stephens' tape distorts (i.e., either flattens or ruffles) when applied along a demarcation line of significant curvature, e.g., along a highlight line on a vehicle body panel. For example, Stephens' tape tends to flatten against the workpiece when it is taped around an outside curve and when paint is sprayed over the flattened tape, it tends to lift portions of the paint as does an ordinary masking tape. When the Stephens' tape is taped around an inside curve, the untreated portion of the tape ruffles so that the paint edge and thickness varies unevenly along the demarcation line, detracting from the quality of the paint job.

U.S. Pat. No. 5,128,176 to Schmidt describes a masking tape for feathering the edge of paint along a demarcation line like Stephens' tape except that it is formed of an elastomeric material which allows it to be used on curved surfaces. Schmidt's tape is of substantial thickness with a core that in cross-section diverges away from the workpiece, forming an overhanging ledge, functionally equivalent to Stephens' untreated portion of the tape. In refinish work, Schmidt's tape is positioned along the demarcation line and paint sprayed into the pocket formed between the tape and the workpiece, feathering the edge of the paint. The core in Schmidt's tape is made of polystyrene and the tape has a paper liner which must be removed before the tape can be applied to the workpiece.

Schmidt's masking tape could not be used on a production line as its polystyrene core does not withstand drying oven temperatures and the paper liner would pose a disposal problem as many feet of tape are needed for each vehicle. In addition, an operator has no time to remove a paper liner as he must apply the tape quickly before the vehicle passes his station.

SUMMARY OF THE INVENTION

In view of the above, it is an object of the present invention to provide a method for spray application or removal of a coating to objects, said method forming a sharp demarcation line between a first section to be spray treated and a contiguous second section to be masked. It is another object to provide a method for spray application of paint wherein the masking tape is flexible so that it can be used on curved surfaces and the paint does not contact the leading edge of the tape. It is also an object to provide a flexible tape that is specially engineered for masking a vehicle along a highlight line so that the leading edge of the paint does not contact the wet film of paint. Other objects and features of the invention will be in part apparent and in part pointed out hereinafter.

In a first aspect, the present invention provides a method for the spray application or removal of a coating to objects having a first section to be spray treated and a contiguous second section to be masked. For this method, a tape is provided including a body with a top surface and a bottom surface connected by at least one lateral edge. A pressure sensitive adhesive adapted to adhere to the second section is provided on the bottom surface of the body. When the bottom surface is adhered to the second section, it forms a vertex with the second section proximate a demarcation line between the first and second sections. The lateral edge of the tape has a leading portion sloped upwardly and outwardly from the bottom surface and overhanging the vertex.

A spray head is provided for spraying coating or grit on the first section adjacent the tape at an angle $\alpha$ greater than an included angle $\beta$ between the second section and a line passing though the vertex and the extreme of the leading portion of the lateral edge. The leading portion of the lateral edge shadows the vertex from the spray and forms a shadow zone about the vertex.

The tape is applied to the object with the shadow zone between the vertex and the demarcation line and coating or grit is sprayed from the spray head on the first section with the second section protected by the shadow zone. spraying is terminated when a desired amount of coating has been applied or removed and the tape removed from the second section revealing the sharp demarcation line that has been formed between the first and second sections.

A second aspect of the invention concerns a masking tape specially designed for use in spray painting vehicles on a production basis. The tape is like that described above except that the body is formed of rubber and a release coating is adhered to the top surface of the body so that the tape can be self-wound.

The invention summarized above comprises the methods and the construction hereinafter described, the scope of the invention being indicated by the subjoined claims.

BRIEF DESCRIPTION OF THE DRAWINGS

In the accompanying drawings, in which two of various possible embodiments of the invention are illustrated, corresponding reference characters refer to corresponding parts throughout the several views of the drawings in which.

DETAILED DESCRIPTION OF THE INVENTION

Figure 2:
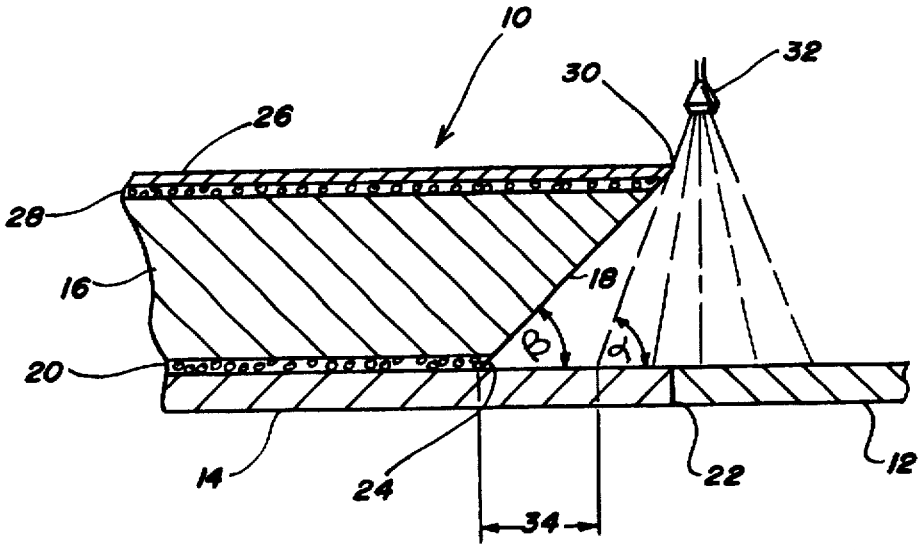
FIG. 2 is a cross-sectional view of a tape in accordance with the present invention during spray head application of a coating in accordance with the present invention.
Figure 3:
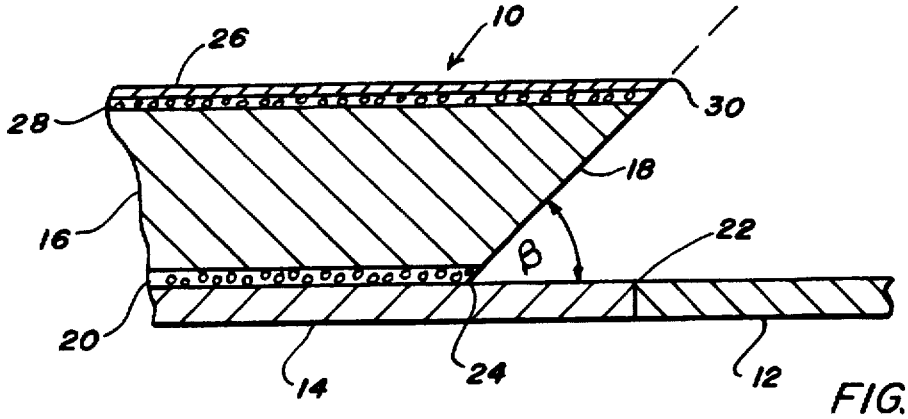
FIG. 3 is a cross-sectional view of the tape shown in FIG. 2 without the spray head.

Referring to the drawings more particularly by reference character, as shown in FIGS. 2 and 3, reference numeral 10 refers to a masking tape for spray application or removal of coatings on a workpiece having a first section 12 to be sprayed and a contiguous second section 14 to be masked in accordance with the present invention. As shown in FIG. 3, tape 10 has a body 16 with a top surface and a bottom surface connected by at least one lateral edge 18. The bottom surface is coated with a pressure sensitive adhesive 20 adapted to adhere to second section 14 proximate a demarcation line 22, said bottom surface forming a vertex 24 with the second section. The top surface may be provided with a release coating 26 which is releasably compatible with adhesive 20 and which is adhered to the top surface of body 16 with a second pressure sensitive adhesive 28. The lateral edge of tape 10 has a leading portion 30 that is sloped upwardly and outwardly from the bottom surface and overhangs the vertex.

With reference to FIG. 2, a spray head 32 is provided for spraying coating or grit on first section 12 adjacent tape 10 at an angle $\alpha$ greater than an included angle $\beta$ between the second section and a line passing through vertex 24 and the extreme of the leading portion 30 of lateral edge 18. The extreme of the leading portion 30 shadows the vertex from the spray and forms a shadow zone 34 about the vertex, flanking demarcation line 22, in line of sight with the coating or grit being sprayed. It has been found that angle $\beta$ should be between about 30 and 80 degrees, with angle $\alpha$ varying between normal (i.e., 90 degrees) when angle $\beta$ is 80 degrees and 45 degrees when angle $\beta$ is 30 degrees. Within this range, the width of shadow zone 34 is determined by the thickness of tape 10.

In use in applying paint, for example, tape 10 is applied to the workpiece with shadow zone 34 flanking demarcation line 22 and paint is sprayed from head 32 on first section 12. Spraying is terminated before a wet film thickness 36 reaches a depth along the demarcation line such that it will flow into the shadow zone and make contact with lateral edge 18 of tape 10. For this purpose, tape 10 should be at least ⅓ thicker, preferably ⅔ thicker, than the maximum wet film thickness of the paint but need not be, in general, more than 2 or 3 times thicker. For example, if the wet film thickness is 10 mil, the tape must be at least 13 mil (i.e., 1⅓×10 mil) but, in general, need be no more than 30 mil (i.e., 3×10 mil) thick. After the spraying is complete and the paint is dry, tape 10 can be removed from the second section without lifting parts of the paint, lateral edge 18 having never made contact with the wet film of paint.

Paint can be applied by spray head 32 either manually or with robotics. Most favored methods in production situations are: two-fluid atomizing, where air provides the driving force to atomize and impel the paint toward the workpiece surface; simple pressure atomizing, wherein the paint is raised to a sufficiently high pressure for it to atomize upon issuing from an extremely small orifice; and, rotary atomizing, where the liquid is flowed across the surface of a disc or bell shaped rotating member and disintegrated at the edge. Electrostatic charges may be applied to the foregoing apparatuses to cause charged paint particles to move toward a conductive workpiece surface. Electrostatically assisted disc and bell rotary atomizers are particularly favored in the automotive industry. Whatever the form of spray head 32, paint is applied at a rate and with a localized distribution which is less than that which causes running of the liquid across the workpiece surface.

In a preferred form for use in automotive painting on a production basis, tape 10 is preferably self-wound and body 16 is formed of a highly conformable elastomer that can withstand production drying oven conditions. A suitable material identified for this purpose is natural rubber, although other elastomers such as polyolefinic polymers and copolymers including foamed polyethylene may be useful. Release coating 26 is a low surface energy elastomer such as a thin film of low density polyethylene, laminated to the top surface of body 16 with pressure sensitive adhesive 28. Adhesive 20 must stick to the workpiece without leaving an adhesive residue and be releasably compatible with release coating 26.

In the best mode presently known to practice the invention, tape 10 is designed to withstand 350° F. for one hour in a drying oven. Body 16 of tape 10 is formed from a sheet of rubber having a thickness between about 20 and 90 mil, depending on the thickness and composition of the paint being applied. The sheet has a Shore A of 15–30 durometer, which by itself would form a tape that is too stretchy. The sheet is provided by the supplier with pressure release adhesive 20 applied to one side, protected with a paper liner. The pressure release adhesive is rubber based and has a 180° adhesion to glass of about 20 oz/in. Release coating 26 is formed from a thin film of polyethylene having a thickness of about 3 mil. If the polyethylene film is too thin (e.g., 1 mil), tape 10 is too stretchy, whereas if the film is too thick (e.g., 5 mil), the tape is too stiff. In the form supplied by the manufacturer, pressure release adhesive 28 is rubber based and is applied to one side of release coating 26 and has an adhesion to steel of 25 oz/in and to backing of 15 oz/in.

Figure 1:
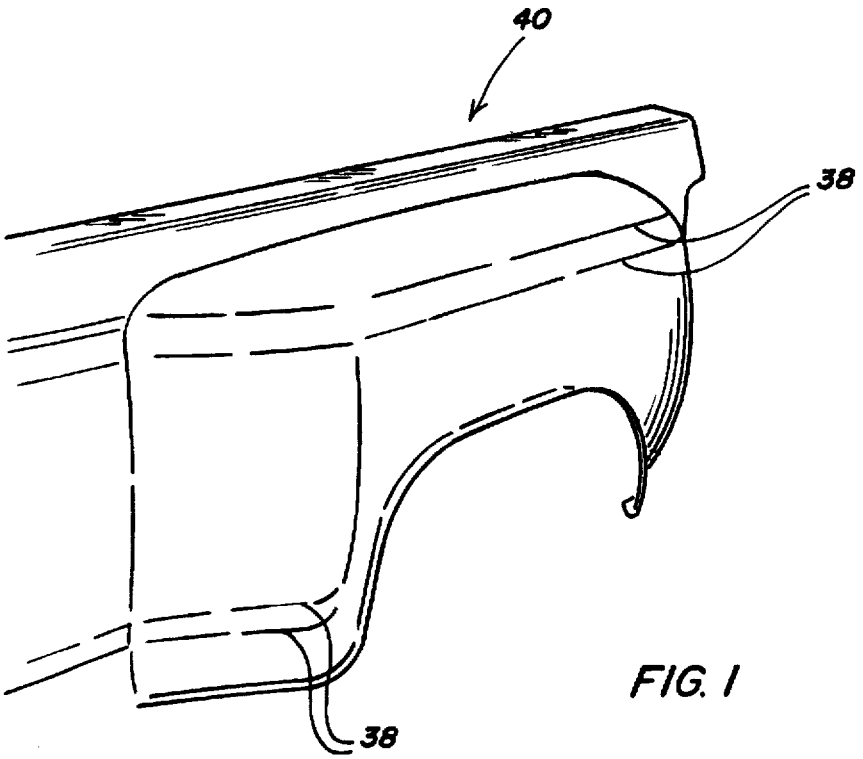
FIG. 1 is a perspective view of a rear truck panel showing a number of highlight lines tending to divide the panel into sections for use in accordance with the present invention.
Figure 5:
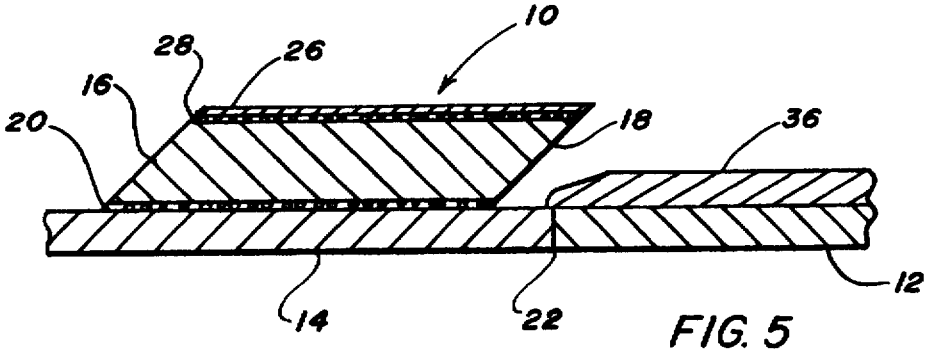

Tape 10 is formed when pressure release adhesive 28 on the polyethylene film is applied to the untreated side of the rubber sheet forming a laminate while the liner is removed from the bottom of the rubber sheet. The laminate is then sent through cutters where sloped lateral edge 18 is formed as the sheet is cut into strips, preferably having a width of about ¾ inch to 1½ inches. The strips are then cut into a length suitable for masking along a highlight line 38 of a vehicle 40 as shown in FIG. 1, for example 50-foot lengths in the case of a truck, and are coiled into self-wound rolls of tape 10, ready for use. For ease of manufacture, the trailing edge of each strip of tape is formed as leading edge 18 of the following tape is cut, forming as shown in FIG. 5, a rhomboid with parallel first and second lateral edges, other shapes in cross-section are possible and for some applications may be preferred, e.g. trapezoidal, etc.

With automobile enamels having a solids content of about 35%, applied in a number of coats, it is preferred that the tape have a thickness of about 45 mil, other thicknesses of tape may be preferred, however, for other applications. For example, a 10 mil tape may be used when the wet film thickness of the paint is 2 mil. Such a tape is flexible enough to be taped over a line of rivets or the like, sealing them under the tape, so as to prevent underspray along the mask line.

In use, tape 10 can be applied along highlight line 38 of a vehicle so that leading portion 30 forms shadow zone 34, flanking demarcation line 22. By engineering the tape so that the slope of the leading portion 30 of the tape and the slope of the leading edge of the paint being sprayed are at the required angles, shadow zone 34 is protected from the paint. By further engineering the tape so that the thickness of the tape exceeds the maximum wet film thickness by the required amount and by controlling the rate of application so that the paint does not run, no paint comes in contact with lateral edge 18. The remainder of the vehicle surrounding the portion to be painted is covered with paper or the like, taped to the masking tape, in conventional fashion so that only the panel to be spray painted is exposed.

In best mode form, an operator can use tape 10 to quickly mask along the sides of a truck, for example, and across the tailgate as the vehicle passes his work station, from left to right or right to left, depending on which side of the vehicle he is working. When tape 10 has a cross-section like that shown in FIG. 5, the tape must be supplied in right and left hand form, easily distinguished by providing release coating 26 in two different colors.

The present method is useful for the application of other coatings, for example to plasma or flame spraying wherein a protective metal, ceramic or plastic coating is applied to a part. Plasma spraying typically is achieved with a plasma gun or similar device which heats the metal, ceramic or plastic to the melting point and then sprays the melted material on a surface to produce a thin metal, ceramic or plastic coating. In plasma or flame spraying, it is important to mask certain areas of a part in order to prevent application of the coating. Reasons for masking an area include preventing the coating from entering apertures in the part, maintaining dimensions within a critical range, weight savings and the like. To achieve such masking, a masking tape is applied over the areas on which the coating is not desired.

Plasma or flame spraying masking tape must exhibit excellent thermal and abrasion-resistance, both in protecting adjacent surfaces from the grit blasting that is typically used as a surface preparation (e.g., in spraying metal or ceramic coatings) and the actual plasma spray coating. Such tape must not lift off or degrade during this demanding process but, after it is over, must be quickly and easily released from the part without leaving an adhesive residue. Conventional plasma spray tapes typically include a glass fabric which is impregnated with a silicone adhesive. A release liner is usually employed for convenient handling. Other types of masking tapes include a thin aluminum foil laminated to a fiberglass cloth.

Figure 4:
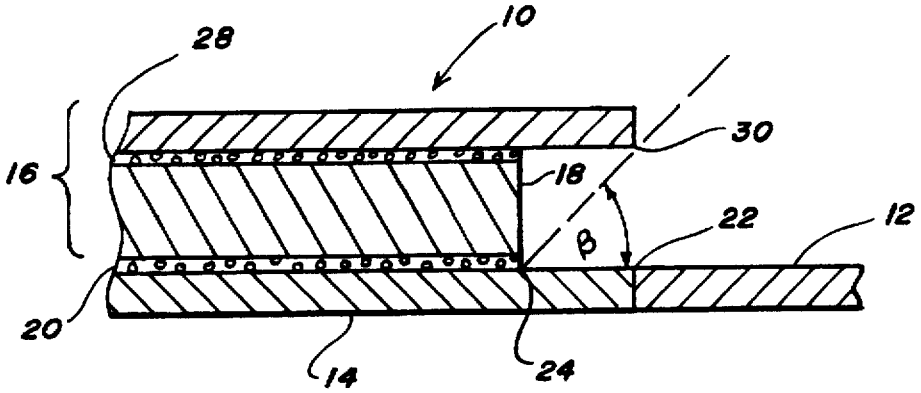
FIG. 4 is a cross-sectional view of a second tape in accordance with the present invention; and, FIG. 5 is a cross-sectional view, on a reduced scale, of the first tape after spray application of a wet film of paint.

For use as a plasma or flame spray masking tape in accordance with the present invention, tape 10 has a lateral edge 18 with a leading portion 30 that is sloped upwardly and outwardly from the bottom surface and overhangs the vertex as described above with respect to flexible tapes. In this instance, however, body 16 is formed of glass fabric, fiberglass, foil or the like. When it is difficult to cut the lateral side edge of the tape at the required angle, tape 10 may be formed as shown in FIG. 4 by gluing overlapping body portions with adhesive 28, thereby producing a shadow zone as before.

In view of the above, it will be seen that the several objects of the invention are achieved and other advantageous results attained. As various changes could be made in the above methods and construction without departing from the scope of the invention, it is intended that all matter contained in the above description or shown in the accompanying drawings shall be interpreted as illustrative and not in a limiting sense.

What is claimed:

1. A method for the spray application of paint to a surface of an object having a first section to be spray painted and a contiguous second section to be masked, said method comprising:

providing a flexible tape including a body with a top surface and a bottom surface connected by at least one lateral edge, said bottom surface having a pressure sensitive adhesive adapted to adhere to the second section, said bottom surface forming a vertex with the second section proximate but spaced from a demarcation line between the first and second sections, said lateral edge having a leading portion, said leading portion of said lateral edge sloped upwardly and outwardly from the bottom surface and overhanging the vertex;

providing a spray head for spraying paint on the first section adjacent the tape at an included angle a between a leading edge of the spraying paint and the surface of the object, said angle $\alpha$ being greater than an included angle $\beta$ between the second section and a line passing through the vertex and the extreme of the leading portion of the lateral edge, said leading portion of the lateral edge shadowing the vertex from the spray and forming a shadow zone about the vertex;

applying said tape to the object with the shadow zone between the vertex and the demarcation line between the first and second sections;

spraying a full-thickness layer of paint from the spray head on the first section, said second section being protected by the shadow zone;

terminating spraying when the layer of saint at the demarcation line substantially reaches full-thickness before the paint flows into the shadow zone and makes contact with the lateral edge of the tape;

allowing the paint to dry; and, removing the tape from the second section whereby a sharp demarcation line is formed between the first and second sections.

2. The method of claim 1 wherein the body of the tape is rubber and a release coating is adhered to a top surface of the tape, said release coating being a polyethylene film.

3. The method of claim 2 wherein the rubber is between about 20 and 90 mil thick and the polyethylene film is between about 2 and 3 mil thick.

4. The method of claim 2 wherein the angle $\alpha$ is between about 45 and 90 degrees and wherein the angle $\beta$ is between about 30 and 80 degrees and tape is at least ⅓ thicker than a maximum wet film thickness of the paint.

* * * * *